United States Patent [19]

Axelrod

[11] Patent Number: 4,906,156

[45] Date of Patent: Mar. 6, 1990

[54] METHOD OF BINDING A BOOK

[76] Inventor: Herbert R. Axelrod, 211 W. Sylvania Ave., Neptune City, N.J. 07753

[21] Appl. No.: 209,319

[22] Filed: Jun. 21, 1988

[51] Int. Cl.[4] ..... B42C 11/04; B42C 11/02; B42C 9/00; B42B 4/00

[52] U.S. Cl. ..... 412/21; 412/19; 412/8; 412/6

[58] Field of Search ..... 412/416, 3, 8, 19, 21, 412/33, 36, 37; 270/32; 281/29, 21

[56] References Cited

U.S. PATENT DOCUMENTS

| | | | |
|---|---|---|---|
| 680,554 | 8/1901 | Ward | 412/6 |
| 2,434,502 | 1/1948 | Martin et al. | 412/19 |
| 3,135,531 | 6/1964 | Rankin | 412/8 |
| 3,292,951 | 12/1966 | Schoenberger | 412/21 |
| 3,437,506 | 4/1969 | Falberg | 412/8 |
| 4,299,410 | 11/1981 | Jukola | 412/8 |
| 4,741,655 | 5/1988 | James | 412/6 |

*Primary Examiner*—Douglas D. Watts
*Assistant Examiner*—Paul M. Heyrana, Sr.
*Attorney, Agent, or Firm*—Fulwider, Patton, Lee & Utecht

[57] ABSTRACT

A method of binding a book which includes gathering and binding a plurality of signature pages into a book block, connecting first and second upper end pages by a buckram hinge strip, connecting third and fourth lower end pages by a buckram hinge strip, sewing the hinge strips, top and bottom end pages and the inner portion of the book block together and then gluing a cover to the exterior of the top and bottom end pages, hinge strips and spine of the book block.

2 Claims, 2 Drawing Sheets

METHOD OF BINDING A BOOK

BACKGROUND OF THE INVENTION

The present invention relates to an improved method of binding a book.

With book binding methods employed heretofore, there has been a serious problem of cracking of the book covers due to constant opening and closing. Additionally, with heretofore propose book binding methods the binding often becomes loosened when the glue utilized to form the spine fails. Another problem of prior art book binding methods lies in the cost of proper dimensioning a book, particularly in the case of paperback books which must be manufactured at a sufficiently low cost to permit the mass merchandising thereof.

SUMMARY OF THE INVENTION

The primary object of the present invention is to provide a method of binding a book which provides an extremely strong book construction and yet the binding method can be achieved by mass production means.

Another object of the present invention is to provide a method of binding books wherein the resulting cover has great resistance against cracking due to constant opening and closing.

Yet a further object of the present invention is to provide a method of binding a book wherein the dimensioning thereof can be established by vertically trimming the body thereof after the book has been assembled.

BRIEF DESCRIPTION OF THE DRAWINGS

These and other objects and advantages of the present invention will become apparent from the following detailed description, with reference to the accompanying drawings wherein.

DESCRIPTION OF A PREFERRED EMBODIMENT

Figure 1:
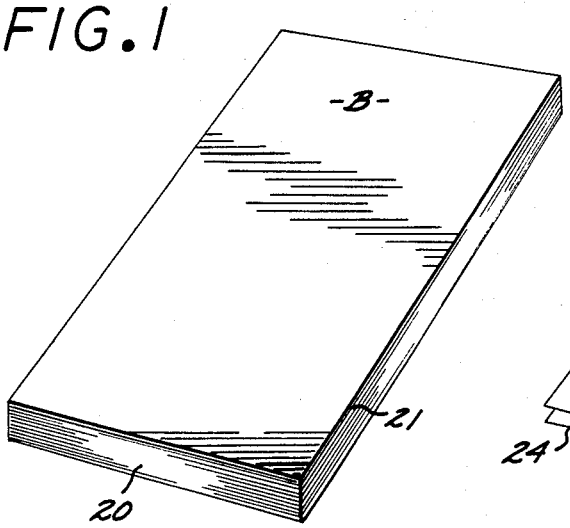
FIG. 1 is a perspective view of plurality of signature pages which have been gathered and bound into a book block.

Referring to the drawings, there is shown in FIG. 1 a perspective view of a plurality of signature pages 20, which have been gathered and bound into a book block B. Preferably, the gathering and binding of the signatures 20 into book block B will be effected in accordance with the teachings of my U.S. Pat. No. 4,106,148. The vertically aligned inner edges of the bound signatures 20 define a spine 21.

Figure 2:
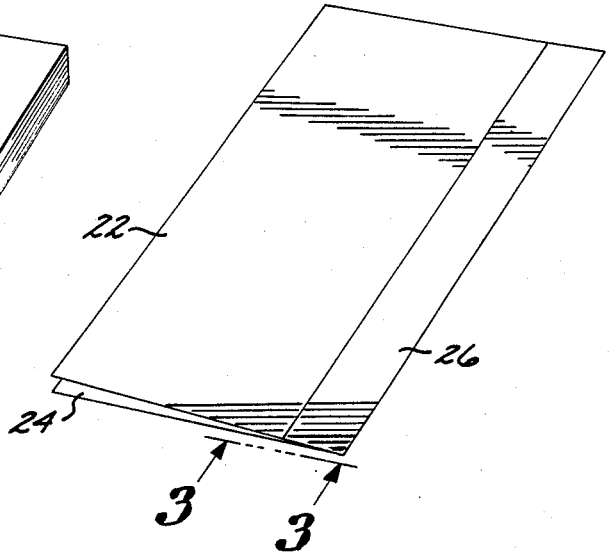
FIG. 2 is a perspective view of upper and lower end pages interconnected by a flexible hinge strip.
Figure 3:
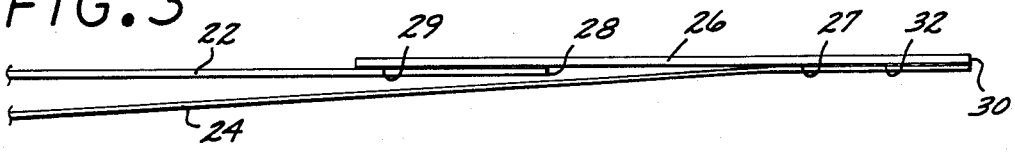
FIG. 3 is a vertical sectional view taken in enlarged scale along line 3—3 of FIG. 2.

FIGS. 2 and 3 show first and second upper end pages 22 and 24, which are interconnected by a rectangular upper hinge strip 26 formed of a flexible material, such as buckram, which can undergo constant flexing without damage. As indicated in FIG. 3, the topmost end page 22 is shorter than second end page 24 and has its inner edge 28 spaced outwardly from the inner edge 30 of the second page 24. The inner underside 27 of the hinge strip 26 is glued to the inner upper surface 29 of the topmost end paper 22, while the inner underside 27 of the hinge strip 26 is glued to the upper surface 32 of the inner portion of the second end page 24.

Figure 4:
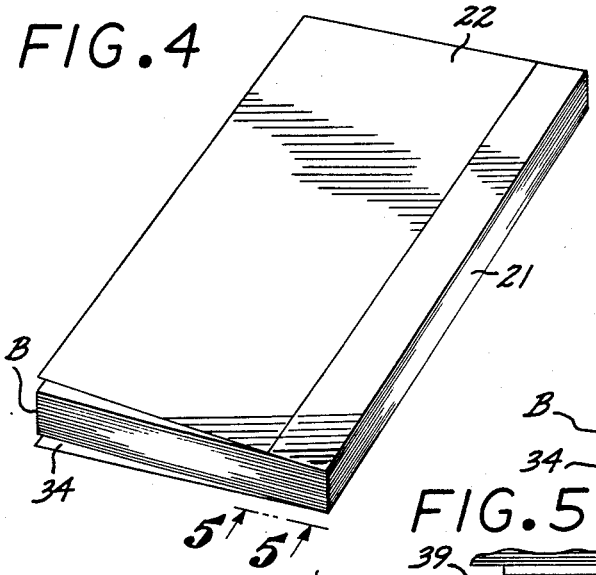
FIG. 4 is a perspective view of the book block of FIG. 1 and the end papers of FIG. 2 in a glued-together relationship.
Figure 5:
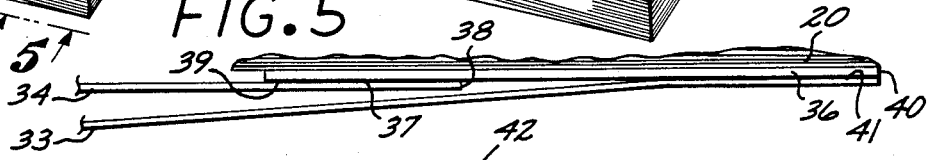
FIG. 5 is a vertical sectional view taken in enlarged scale along line 5—5 of FIG.4.

Referring to FIGS. 4 and 5, it should be understood that third and fourth lower end pages 33 and 34 are provided with a lower flexible hinge strip 36 of buckram or the like. As indicated in FIG. 5, the bottommost end page 34 is shorter than the third end page 33 and has its inner edge 38 spaced outwardly from the inner edge 41 of the third page 33. The inner underside 37 of the hinge strip 36 is glued to the inner upper surface 39 of the fourth end paper 34, while the inner underside 37 of the hinge strip 36 is glued to the upper surface 40 of the inner portion of the third end page 33. It should also be understood the inner edges of both the upper and lower hinge strips 26 and 36 substantially coincide with the vertical plane of the spine 21.

Figure 6:
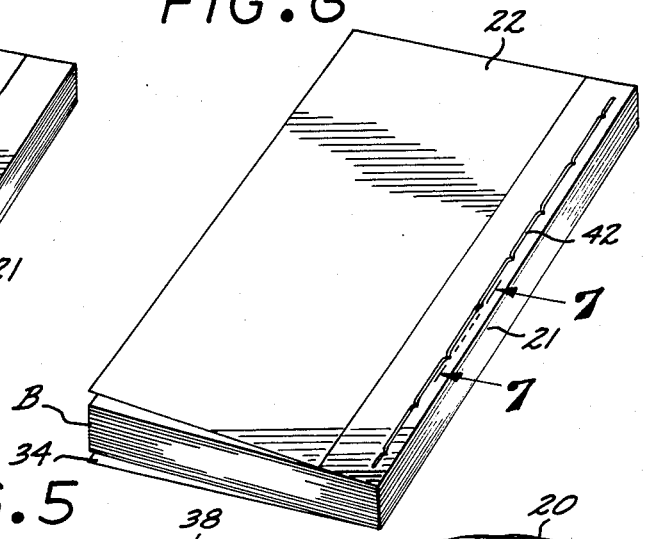
FIG. 6 is a view similar to FIG. 4, but showing the hinge strip and inner portion of the book block sewed together.
Figure 7:
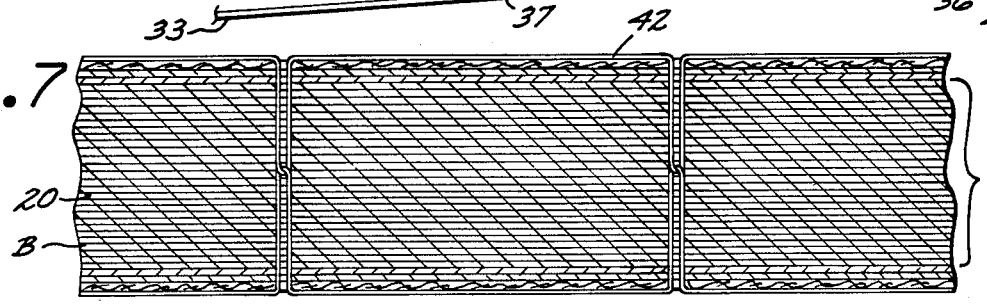
FIG. 7 is a vertical sectional view taken in enlarged scale along lines 7—7 of FIG. 6.
Figure 8:
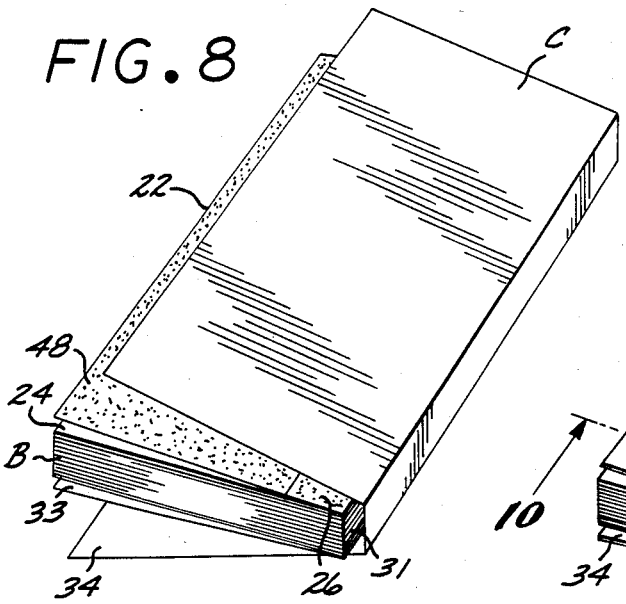
FIG. 8 is a perspective view similar to FIGS. 1, 4 and 6 showing the assembled book block and end pages receiving a cover.
Figure 9:
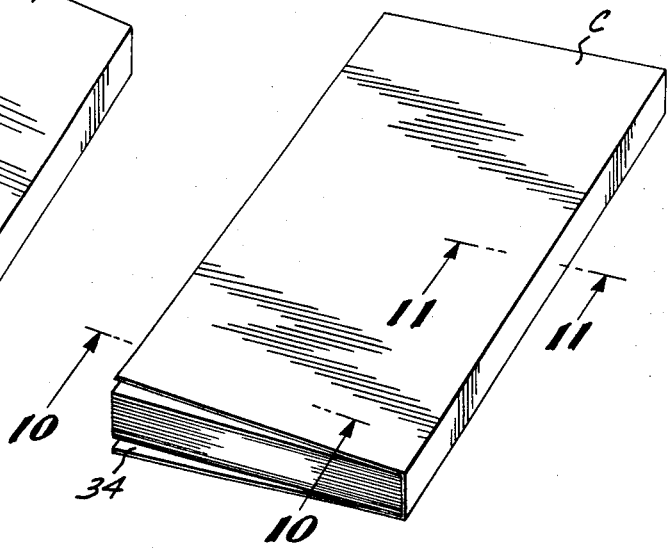
FIG. 9 is a perspective view similar to FIG. 4 after the cover has been glued to the exterior of the end pages hinge strips and the spine of the book block.
Figure 10:
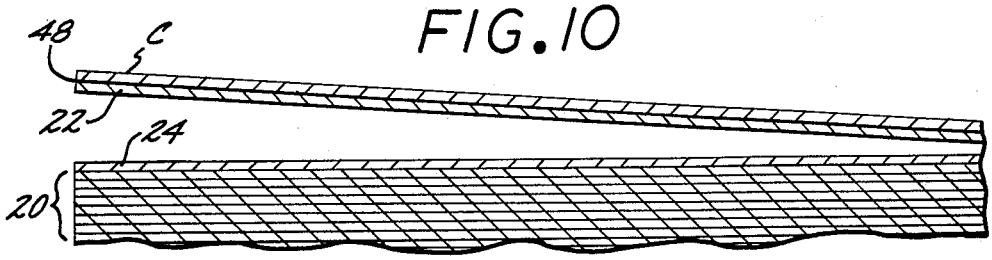
FIG. 10 is a vertical sectional view taken in enlarged scale along lines 10—10 of FIG. 9.
Figure 11:
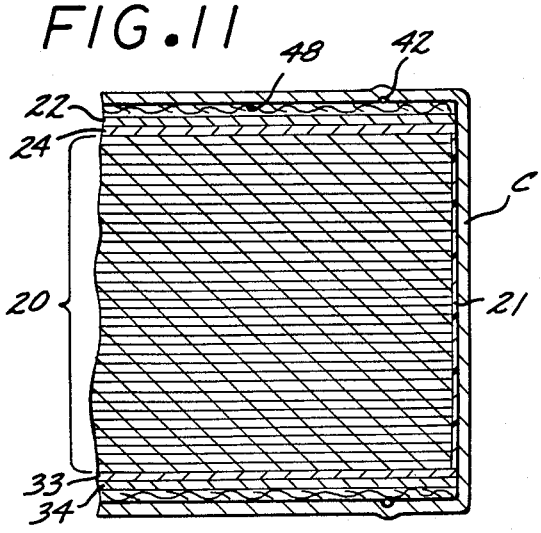
FIG. 11 is a vertical sectional view taken in enlarged scale along lines 11—11 of FIG. 9.

Referring again to FIG. 4, the upper end pages 22 and 4 and their hinge strip 26 are shown placed on top of the book block B. Similarly, the lower end pages 33 and 34 with their hinge strip 36 are stacked below the book block B. Thereafter, the hinge strips 26 and 36, the inner part of the top and bottom end pages 24 and 34 and the inner portion of book block B are sewed together by thread 42 by means of a conventional sewing arrangement, as shown in FIGS. 6 and 7. Such threading insures that the signature pages 20 will not fall out of the completed book, and also that the upper and lower end pages remain securely attached to the book block B.

The next step in the book binding method of the present invention as shown in FIGS. 8–11, is to glue a conventional cover C tightly onto the book block B with as close to a 100% glued surface between the interior surfaces of cover C and the exterior surfaces of the book block B and the hinge strips 26 and 36 as possible. A suitable glue 48 is applied in a conventional manner to the exterior of the hinge strips 26 and 36, top and bottom end pages 22 and 34, and spine 21 in order to carry out such step. If desired, glue may also be applied to the inside of the cover C.

Figure 12:
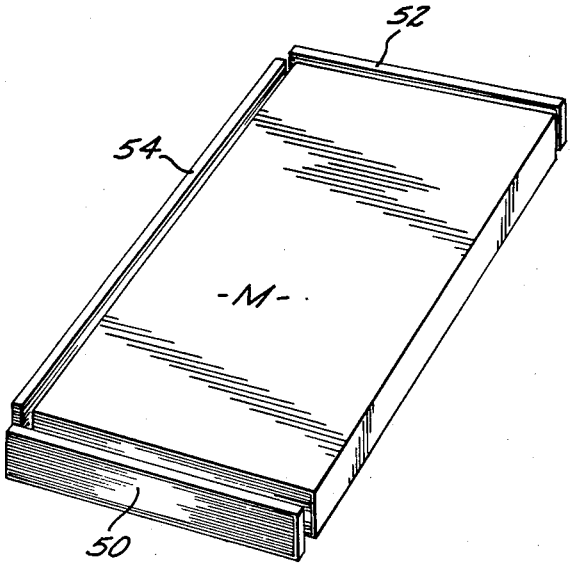
FIG. 12 is a perspective view showing how the finished book can be trimmed to its final dimensions.

Referring now to FIG. 12, conveniently, the final dimensioning of a book bound by the method of the present invention may be accomplished by vertically trimming the covered assembled book member M. Thus, in FIG. 12 a first cut 50 has been made so as to trim off one end of the covered assembled book member, a second cut 52 has been made to trim off the opposite end of such assembly, and a third cut 54 has been made to trim off the outer edge of the assembly. It should be understood however, that such dimensioning may not require three separate cuts but only one or two thereof.

The aforedescribed book binding process is usable in the manufacture of both paperback books and hard cover books. This method is particularly useful in the manufacture of paperback books because it can be carried out at a comparatively low cost to permit the mass merchandising of such paperback books. When utilized to manufacture either a paperback or a hard cove book the covers will remain tightly adhered to the book block during the life of the book. Additionally the cover has great resistance against cracking even though such cover is subject to constant opening and closing over the life of the book.

If desired, the book manufactured in accordance with the method of the present invention may be provided with a vinyl jacket to protect it from humidity, sunlight fading, sticky fingers, and damage in storing and shipping. A preferred arrangement for providing such a jacket is disclosed in my co-pending U.S. Pat. application Ser. No. 07/170,983 filed Mar. 21, 1988 and entitled Wrap-Around Cover For A Bound Book.

Various modifications and changes may be made with respect to the foregoing detailed description without departing from the spirit of the present invention.

I claim:

1. A method of binding a book, comprising:

gathering and binding a plurality of signature pages into a book block, the inner edges of the signature pages defining a spine;

vertically aligning first and second upper end pages, the first end page being topmost of the two end pages and having its inner edge spaced outwardly from the inner edge of the second end page;

providing an upper flexible hinge strip;

gluing the outer underside of said hinge strip to the upper surface of the inner portion of the first end page;

gluing the inner underside of said hinge strip to the upper surface of the inner portion of the second end page;

vertically aligning third and fourth lower end pages, the fourth end page being bottommost of the two end pages and having its inner edge spaced outwardly from the inner edge of the third end page.

providing a lower flexible hinge strip;

gluing the outer underside of said lower hinge strip to the upper surface of the inner portion of the fourth end page;

gluing the inner underside of said hinge strip to the upper surface of the inner portion of the third end page;

stacking the book block between the upper and lower end pages, the upper and lower end pages being positioned above and below the book block, respectively;

sewing the hinge strips, first and fourth end pages and the inner portion of the book block together; and, gluing a cover to the exterior of the first and fourth end pages, the hinge strips and the spine of the book block, whereby said hinge strips are visible when the book is opened to the second upper end page or third lower end page.

2. The book binding method of claim 1, wherein the final dimensions of the book are established by vertically trimming the covered assembled book member.

* * * * *